US006298619B1

(12) United States Patent
Davie

(10) Patent No.: US 6,298,619 B1
(45) Date of Patent: Oct. 9, 2001

(54) MODULAR BUILDING FRAME SYSTEM

(76) Inventor: William D. Davie, 162 Woodcreek Dr. N., Safety Harbor, FL (US) 34695

( * ) Notice: Subject to any disclaimer, the term of this patent is extended or adjusted under 35 U.S.C. 154(b) by 0 days.

(21) Appl. No.: 09/517,498

(22) Filed: Mar. 2, 2000

(51) Int. Cl.[7] ..... E04B 1/38; E04B 2/00; E04B 7/00

(52) U.S. Cl. ..... 52/293.3; 52/270; 52/271; 52/274; 52/284; 52/220.7; 52/582.1

(58) Field of Search ..... 52/270, 271, 284, 52/220.7, 91.1, 91.3, 290, 293.3, 274, 582.1, 309.9, 302.1

(56) References Cited

U.S. PATENT DOCUMENTS

| | | | | |
|---|---|---|---|---|
| 1,793,188 | | 2/1931 | Noerenberg . | |
| 2,051,707 | * | 8/1936 | Harrison . | |
| 2,062,160 | | 11/1936 | Calkins et al. . | |
| 2,127,111 | | 8/1938 | Gaenzle . | |
| 3,055,461 | | 9/1962 | De Ridder . | |
| 3,196,499 | * | 7/1965 | Houvener . | |
| 3,397,494 | * | 8/1968 | Waring | 52/293.3 X |
| 3,436,881 | * | 4/1969 | Schlecht . | |
| 3,751,865 | | 8/1973 | Brigham . | |
| 4,019,291 | | 4/1977 | Ernst . | |
| 4,100,704 | * | 7/1978 | Oogami | 52/65 |
| 4,360,553 | | 11/1982 | Landheer . | |
| 4,443,986 | | 4/1984 | Propst et al. . | |
| 4,769,963 | | 9/1988 | Meyerson . | |
| 4,872,297 | * | 10/1989 | Hetzel et al. | 52/92 |
| 4,936,069 | * | 6/1990 | Hunter et al. | 52/309.4 |
| 5,117,602 | | 6/1992 | Marschak . | |
| 5,144,776 | * | 9/1992 | Hetzel et al. | 52/92 |
| 5,259,164 | | 11/1993 | Wiese . | |
| 5,325,641 | | 7/1994 | Felton . | |
| 5,425,214 | | 6/1995 | Truelove et al. . | |
| 5,509,242 | * | 4/1996 | Rechsteiner et al. | 52/270 |
| 5,787,659 | * | 8/1998 | Rinehart | 52/302.1 X |
| 5,811,035 | | 9/1998 | Mockry . | |
| 5,826,380 | * | 10/1998 | Wolfe | 52/90.1 |
| 5,966,888 | | 10/1999 | Richardson . | |
| 6,085,469 | * | 7/2000 | Wolfe | 52/270 X |
| 6,119,410 | * | 9/2000 | Wolfe | 52/71 |

* cited by examiner

*Primary Examiner*—Robert Canfield
(74) *Attorney, Agent, or Firm*—Larson & Larson, P.A.; James E. Larson

(57) ABSTRACT

A building is constructed employing a base plate adapter mounted by a base plate to the exposed end of a rod imbedded in a concrete pad. The base plate adapter has upright sidewalls enclosing a first insulated wall panel. The next upper wall panel is connected to the first wall panel by interlocking fasteners. Comer connectors have first and second U-shaped brackets enclosing a side portion of a wall panel and each bracket pivots with respect to each other. A roof connector joins a top portion of an insulated wall panel to a roof panel. The connector pivots so that the roof panel can be adjusted with respect to the wall panel until a final fixed position is achieved. A roof cap connector joins the top portion of meeting roof panels. The connector pivots until a final fixed position is achieved.

19 Claims, 9 Drawing Sheets

MODULAR BUILDING FRAME SYSTEM

FIELD OF THE INVENTION

This invention relates to factory prefabricated building systems. More particularly, it refers to a modular building system employing aluminum extrusions connected to steel faced building panels having a sandwiched interlayer of polystyrene foam insulation.

BACKGROUND OF THE INVENTION

Modular building systems have been in use since at least 1931 as shown in U.S. Pat. No. 1,793,188.

U.S. Pat. No. 2,062,160 describes panels of sheet steel used for the frame work of a building. Adjacent panels of the wall are connected ridgally together by the use of interengaging flanges arranged in box formation along the meeting edges of the panels.

U.S. Pat. No. 2,127,111 describes a structure comprising insulating panels grooved at a portion adapted to contact contiguous panels to define channels between them. There are key strips deposed in the channels and locking devices securing contiguous panels together. The joints are sealed together by compression of the insulating material.

U.S. Pat. No. 3,055,461 describes structural extrusions interlocked together to form structural members.

U.S. Pat. No. 3,751,865 describes a modular building construction fabricated from individual panels. The individual panels consist of frames of extruded metals such as aluminum which by means of snap in moldings support the panels.

U.S. Pat. No. 4,019,291 describes interior wall systems. Each wall frame section includes at least one pair of spaced vertically extended studs and generally horizontal top and bottom stringers for securing the studs in a horizontally spaced position. Each wall frame section includes elongated slots for electrical wires, telephone wires and other utility connection.

U.S. Pat. No. 4,360,553 describes a sandwich type panel that is snap locked together and has a space between each panel. Panels can be assembled together on all sides by a double tongue and groove connection.

U.S. Pat. No. 4,443,986 describes panels employed to divide large rooms into a number of work stations. Each panel support frame has a first and second space upright and first and second gussets including plate support devices secured to the first and second upright. Each of the gussets defines an upwardly opening slot and each slot includes a portion doubled downwardly inwardly with respect to the gusset. A wall panel is mounted within the support frame and a mounting stud extends from the wall panel and is secured within one of the gussets.

U.S. Pat. No. 4,769,963 describes a structural snaplock panel.

U.S. Pat. No. 5,117,602 describes a building including a plurality of structural members connected together forming interconnected walls and floors, each structural member having elongated front panels with lateral ends and side panels extending generally perpendicular from the front panel. Each of the side panels has a generally Z-shaped portion and a first flange at an end of the panel extending toward the other side panel. The adjacent cooperating structural members are nestable with each other at the Z-shaped portions thereof with the flanges of nested side panels cooperating to form a support.

U.S. Pat. No. 5,259,164 describes an improved construction for walls which are constructed of boards and which can be rapidly erected and dismantled and which allow for variable angle adjustments while retaining axis dimension from rotational axis to rotational axis. The coupling element for adjacent wall boards is a hinge, the two sections of which are movable about an axis defining the swiveling axis of the boards and are detachable by a fastening means.

U.S. Pat. No. 5,325,641 describes a system for mounting a panel. There are a pair of studs, each stud having a flange surface which is substantially coplanar with the flange surface of the other stud. A pair of upright members is interposed between the studs and each upright member includes a lip extending generally parallel to a stud flange surface. At least one spring clip is attached to each lip and includes an opening receiving a panel edge.

U.S. Pat. No. 5,966,888 describes a building structure having at least two hollow building elements connected side by side. At opposite sides are coupling members with a coupling member at a first side having a duct. The structure further has a reinforcing beam in the duct member.

Although many of the above described systems have a practical use, there is still a need for a prefabricated building that can be erected with panels that contain insulation and the building is structurally able to withstand 110 mile per hour winds.

SUMMARY OF THE INVENTION

This invention describes a building system that can be pre-fabricated and erected on site with interlocking steel faced panels, the panels containing a sandwiched interlayer of polystyrene foam insulation, attached to multiple aluminum extrusions. The building does not require studs, but can still withstand wind speeds of up to 110 miles, per hour.

The system includes several extrusions. First, a base plate adapter extrusion having a side plate overlapping a side edge of a concrete foundation, a U-shaped component for receipt of a panel, a thermal break and an electrical way with a means for access to the electrical way. Secondly, a roof eve adapter extrusion having a U-shaped component at each end for receipt of opposed roof panels and a means for adjusting the angle of each roof panel with respect to the opposing roof panel. Thirdly, a corner extrusion having a U-shaped component at each end for receipt of panels, with means for adjusting the angle of each wall panel at about 90° with respect to each other. Fourthly, a gable adapter extrusion for the topmost panel having a downwardly U-shaped component for overlapping the top portion of a top panel, together with a base portion on which roof panels are attached. Fifthly, male and female latches interlocking the ends of panels together, but spaced apart sufficiently for receipt of an I-beam between the latches. Lastly, a door or window extrusion having a U-shaped component for receipt of a panel.

BRIEF DESCRIPTION OF THE DRAWINGS

The invention can be best understood by those having ordinary skill in the art of constructing modular buildings by following the detailed description when considered in conjunction with the accompanying drawings in which.

DETAILED DESCRIPTION OF THE INVENTION

Figure 1:
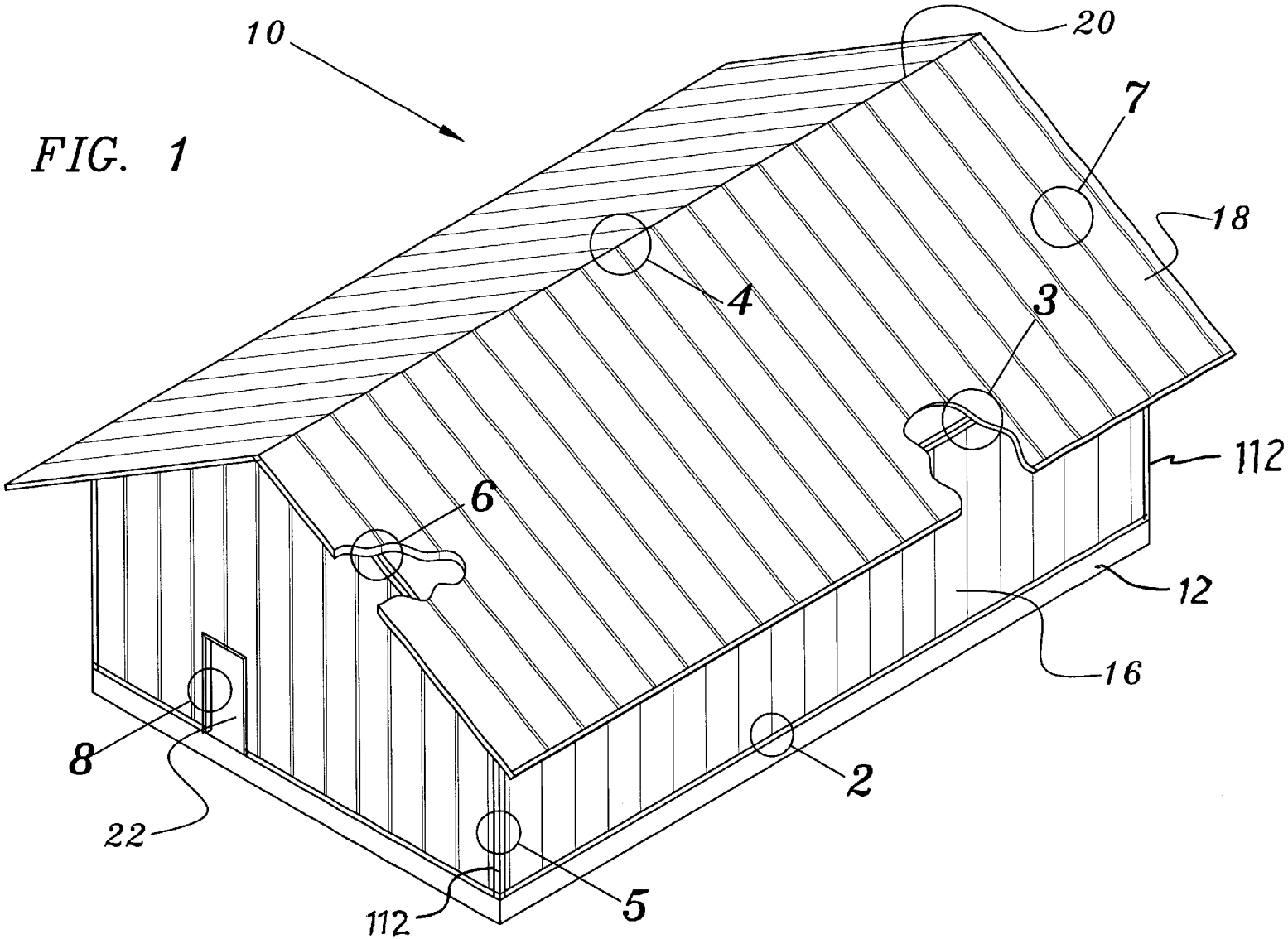
FIG. 1 is a perspective view of a building constructed in accordance with the inventive system.

Throughout the following detailed description, the same reference numerals refer to the same elements in all figures.

The modular building system of this invention is employed to construct a building 10 having insulated side panels 16 and roof panels 18. The building 10 is constructed over a concrete pad 12 as shown in FIG. 1. No studs are required to support the panels 16 nor are roof trusses required to support the roof panels 18.

The building 10 is constructed employing several different extruded aluminum adapters designed to support the insulated panels.

Figure 2:
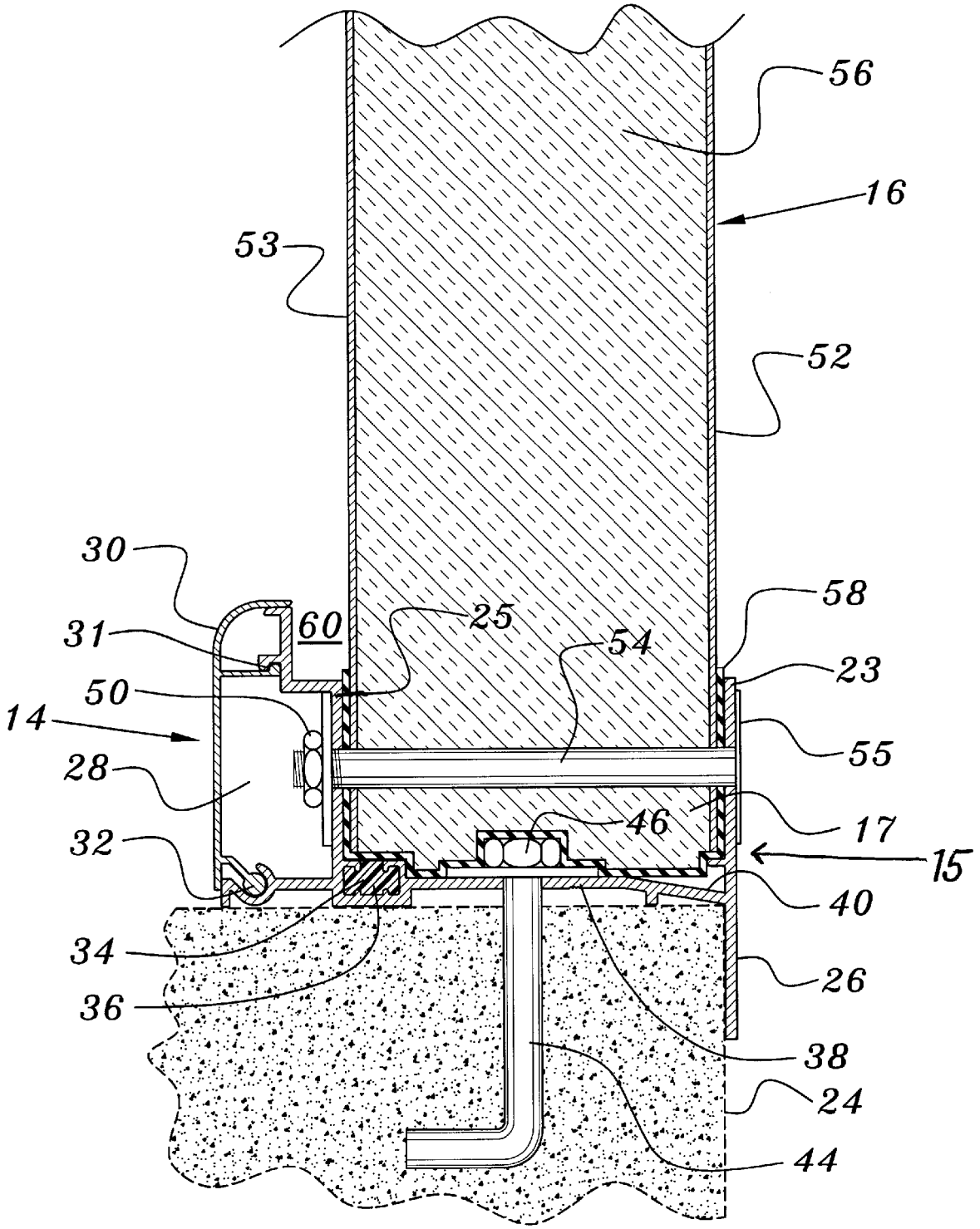
FIG. 2 is a cross-sectional view of a base extrusion and side panel.
Figure 2A:
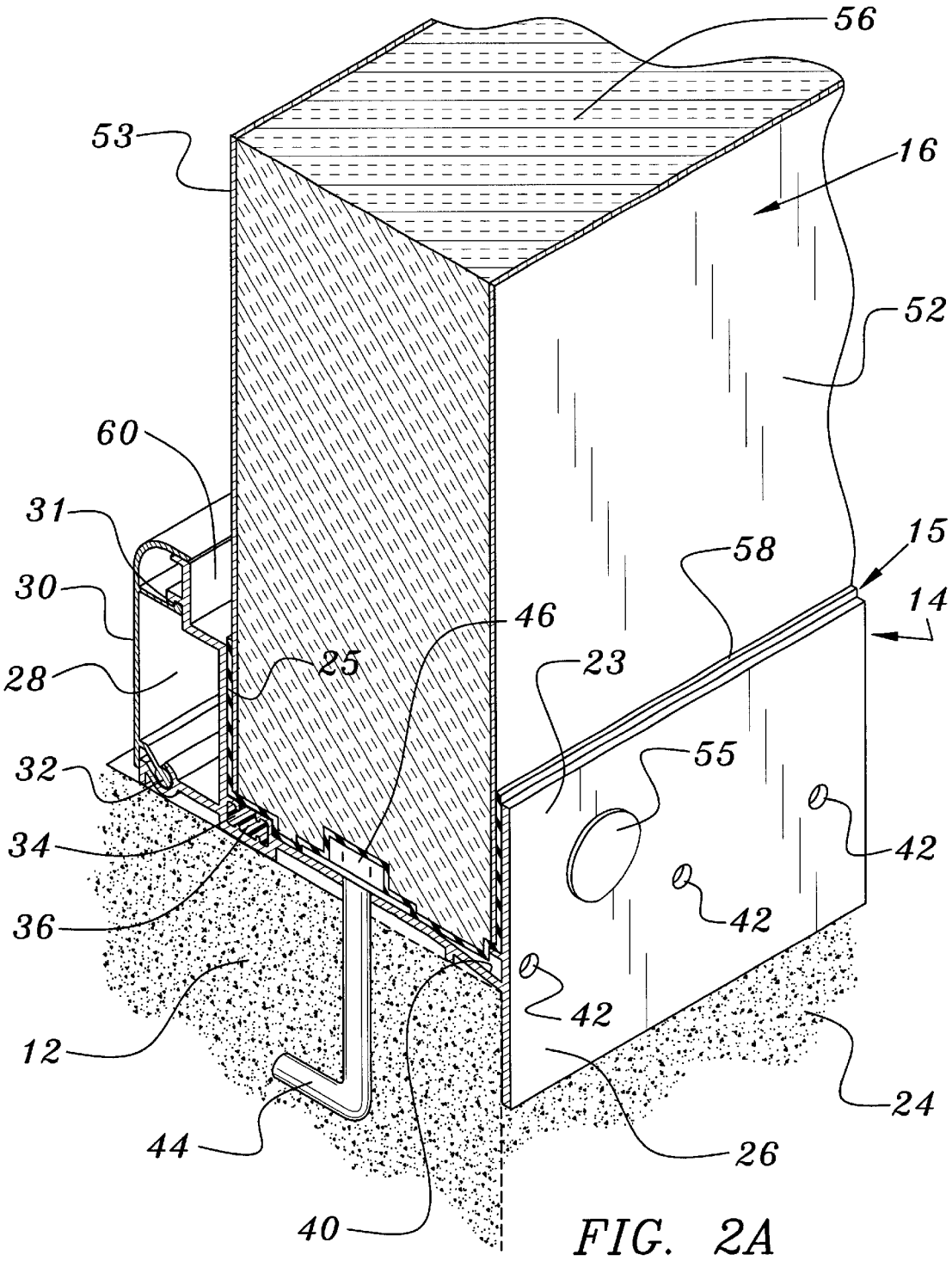
FIG. 2A is a corner cross-sectional view of the base extrusion and side panel.

An edge or base plate adapter 14 shown in FIGS. 2 and 2A is mounted over an edge 24 of the pad 12 so that a lower skirt 26 integral with adapter 14 extends downwardly along edge 24. The adapter 14 has a U-shaped component 15 (a base 38 and sidewalls 23 and 25) for receipt of a bottom portion 17 of a panel 16, and an electrical way 28 distal from the lower skirt 26. The electrical way 28 has a movable plate 30 which pivots outwardly at a pivot point 32. Plate 30 engages a projection from sidewall 25 to form a snaplock 31. A thermal break 34 usually filled with a polymer 36 rests on pad 12. The base 38 of the U-shaped component 15 is spaced above the pad 12 and is sloped down 40 to a hole 42 to allow moisture to drain out. A threaded rod 44 imbedded in the pad 12 is bolted 46 to the bottom 38 of U-shaped component 15. A rubber gasket 58 is applied between the interior of the U-shaped component 15 and the bottom portion 17 of panel 16. A threaded shaft 54 is bolted from bolt head 55 transversely through sidewall 23, through the lower portion 17 of the panel 16, sidewall 25 and is held with nut 50 within the electrical way 28.

The side panel 16 mounted in edge adapter 14 has a steel sheet 52 and 53 on each side sandwiching polystyrene insulation 56. A groove 60 adjacent an inner side 53 of panel 16 is adapted to receive wall board or other aesthetic panels for mounting on the interior of building 10.

Figure 7:
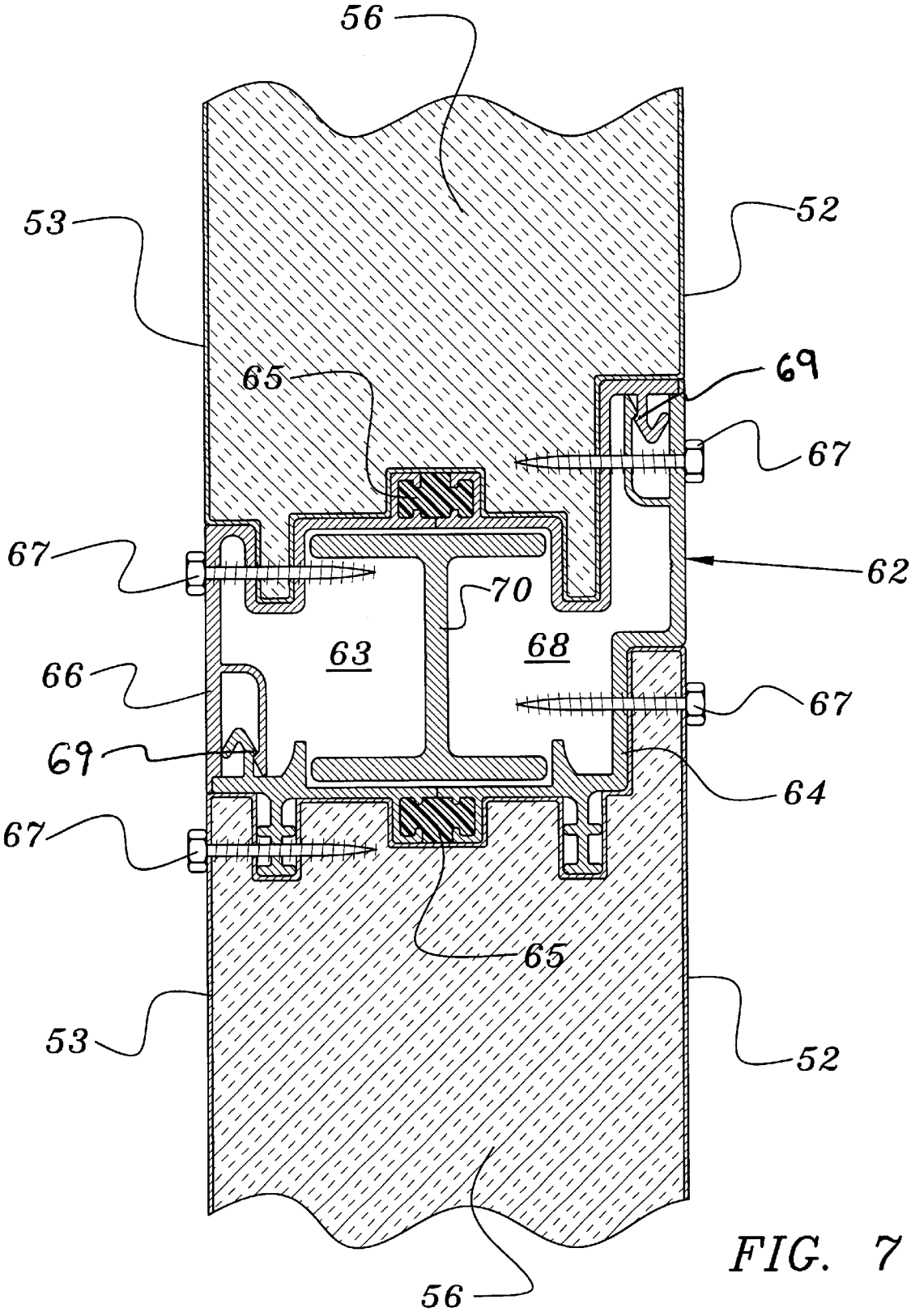
FIG. 7 is a cross-sectional view of a pair of panel end extrusions.

A second or third wall panel or roof panel can be fastened end to end upwardly using the self mating panel locks 62 shown in FIG. 7. An interlock component 64 and 66 are each imbedded in the end of a panel and pressed together to create a snaplock 69. Spaces 63 and 68 are created between the panel ends by the interlock components 64 and 66. Optionally, an I-beam 70 can be inserted in this space to create additional structural integrity, particularly on buildings over sixteen feet high. A thermal break 65 is located at the end of each panel and screws 67 are used to permanently join adjacent panels.

Figure 3:
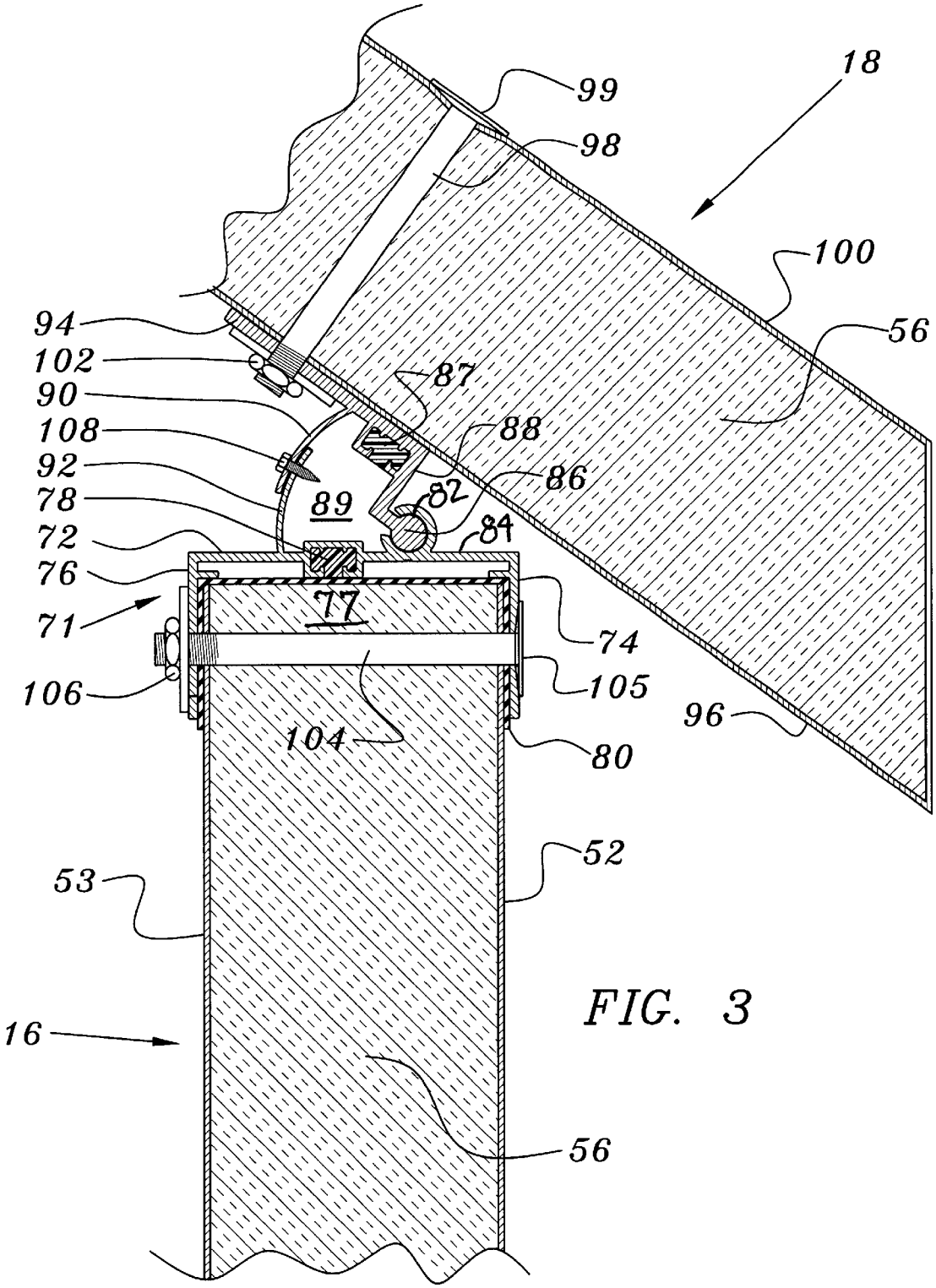
FIG. 3 is a cross-sectional view of a roof extrusion, roof panel and side panel.

A wall/roof eve adapter extrusion 71 shown in FIG. 3 has a base plate 72 with a descending outer sidewall 74 and descending inner sidewall 76 enclosing a top portion 77 of an insulated panel 16. A thermal break 78 is contained within the base plate 72 and a rubber gasket 80 separates the outer and inner sidewalls and thermal break from the insulated panel 16. An annular groove 82 integral with an outside surface 84 of the base plate 72 receives a ball 86 attached to an L-shaped bracket 88. The longer portion 94 of the L-shaped bracket 88 has a descending arcuate leaf 90 that is juxtaposed to a corresponding arcuate leaf 92 upwardly directed from base plate 72. The longer portion 94 of the L-shaped bracket 88 contains a thermal break 87 and supports a lower side 96 of a roof panel 18. A bolt 98, starting at bolt head 99 runs transversely from an upper side 100 of the roof panel, through the insulation, the lower side 96 of the roof panel and the L-shaped bracket 88. A nut 102 holds the bolt 98 in place. The roof panel 18 and side wall panel 16 can pivot with respect to each other at pivot ball 86 until the correct alignment of roof pitch is achieved. A space 89 within leaves 90 and 92 can be used as an electrical way. The upper and lower leaf 90 and 92 are held together with screws 108 for a permanent structure. A threaded bolt 104 with bolt head 105 passes through outer sidewall 74, the rubber gasket 80, the wall panel 16 and the inner sidewall 76. Nut 106 holds the bolt in place.

Figure 5:
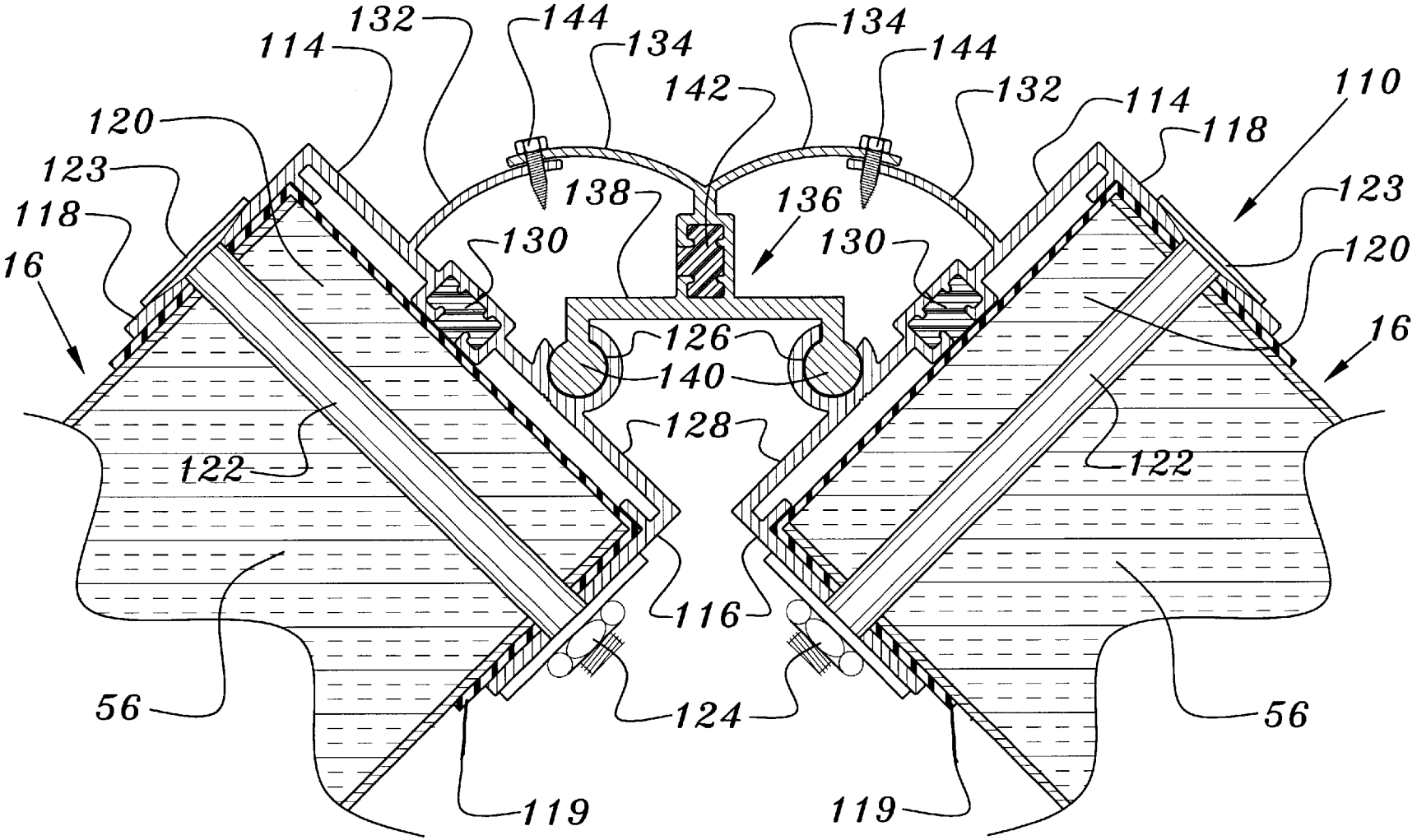
FIG. 5 is a cross-sectional view of a corner extrusion and side panels.

A corner connector extrusion 110 shown in FIG. 5 joins the sides of sidewall panels 16 at building corners 112. A base plate 114 has parallel inner sidewall 116 and outer sidewall 118 that enclose a side portion 120 of a panel 16. A rubber gasket 119 separates inner surfaces of the side walls and base plate from portion 120. A bolt 122 terminated by bolt head 123 runs through the outer sidewall 118, a rubber gasket 119, the insulated sidewall panel 16 and the inner sidewall 116 is held in place by nut 124. An annular pivot groove 126 is located on outside surface 128 of base plate 114. A thermal break 130 is located in each base plate 114. In addition, an outwardly directed arcuate leaf 132 from surface 128 engages a corresponding leaf 134 located on a pivot bracket 136. The pivot bracket contains a bar 138 supporting a pivot ball 140 at each end. Each ball 140 engages a pivot groove 126. The pivot bracket 136 also contains a thermal break 142 located between the bar 138 and the arcuate leaf components 134. The sidewalls can each be pivoted through pivot grooves 126 until a proper orientation is achieved. Thereafter, screws 144 are placed through leaf 132 and 134 to lock the sidewalls in place.

Figure 4:
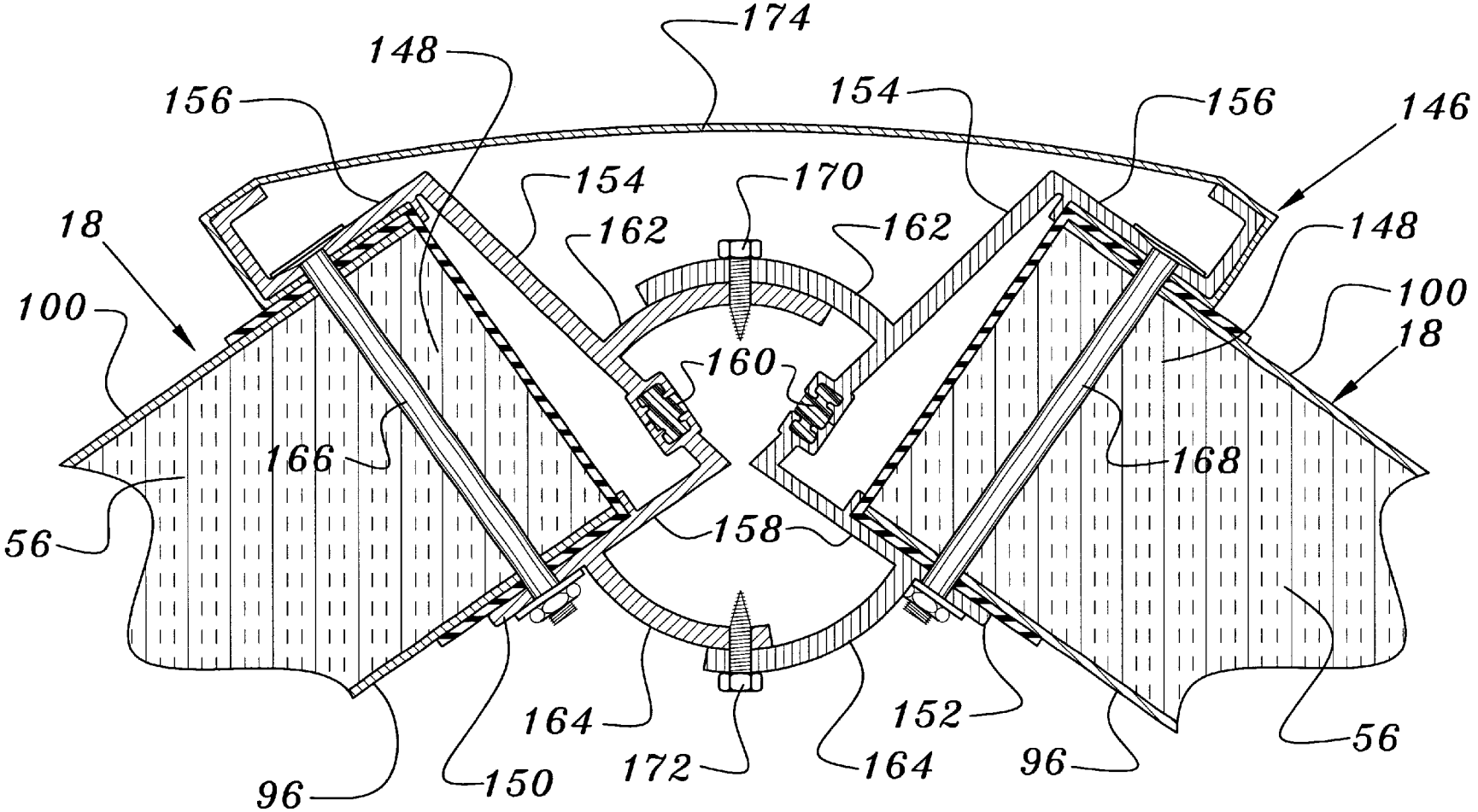
FIG. 4 is a cross-sectional view of a roof peak extrusion and roof panels.

As seen in FIG. 4, a roof cap bracket 146 is used to capture the end portion 148 of roof panels 18 at the roof peak 20. The roof cap bracket 146 has two like component parts 150 and 152. Each component part 150 and 152 has a base 154 and an outer sidewall 156 and inner sidewall 158. Each base 154 contains a thermal break 160 and an upwardly directed leaf 162. Each inner sidewall 158 has a downwardly directed leaf 164. Each of the leaves 162 and each of the leaves 164 are bolted together to form the roof peak 20. A bolt 166 and 168 respectively, hold an upper end portion 148 of the mating roof panels 18 within the bracket 146. Screws 170 and 172 respectively, retain together leaves 162 from each base 154 and leaves 164 from inner sidewalls 158. A thin metal roof cap 174 overlays bracket 146.

Figure 6:
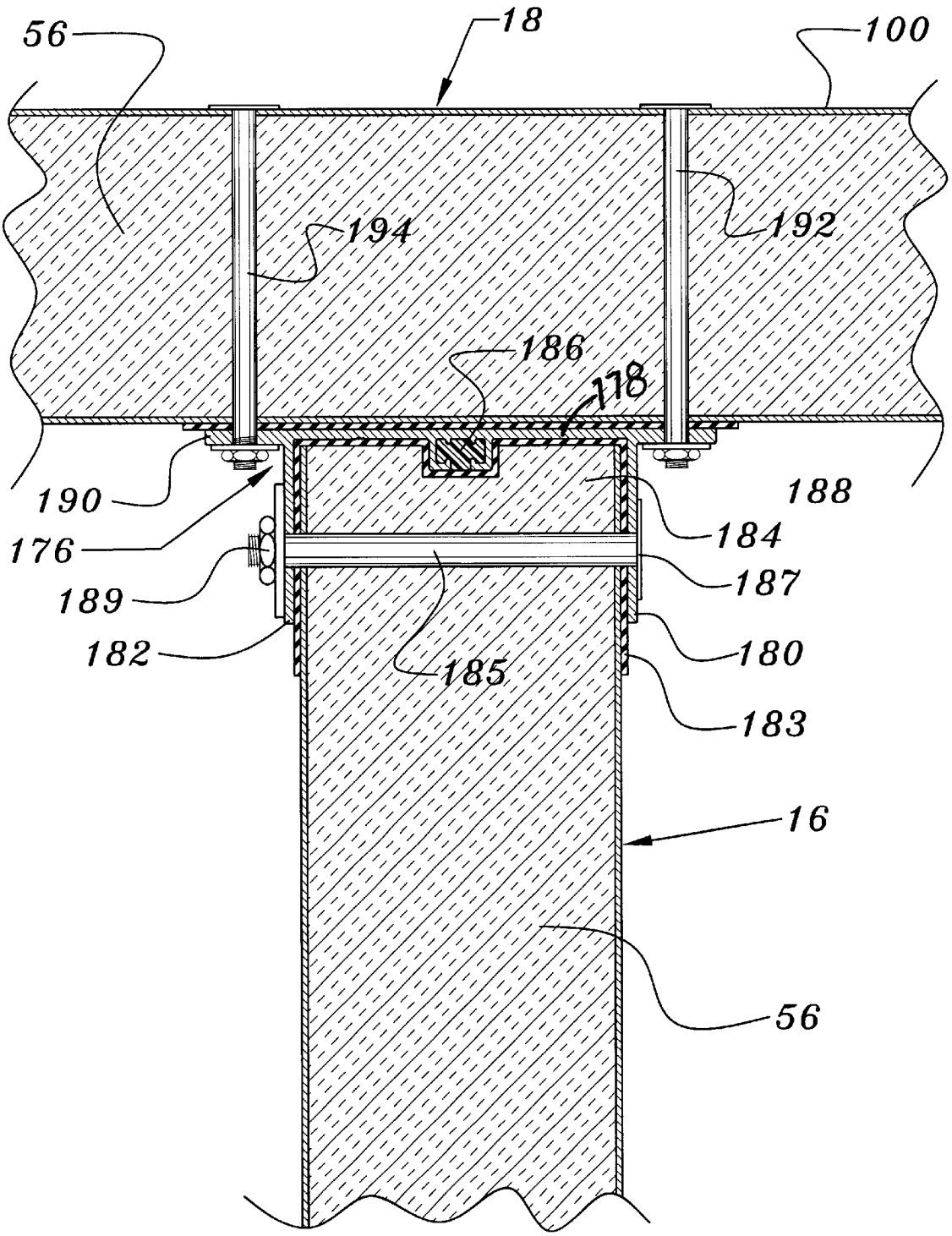
FIG. 6 is a cross-sectional view of a gable adapter extrusion together with a roof panel and wall panel.

As seen in FIG. 6, a gable adapter extrusion 176 connects together a roof panel 18 and side panel 16. The gable adapter 176 has a base 178 and two sidewalls 180 and 182 that encloses the top portion 184 of a wall panel 16. A rubber gasket 183 is applied between the wall panel 16 and the base 178 and sidewalls 180 and 182. The base 178 has a descending thermal break 186 and the base 178 has lateral ears 188 and 190 which are bolted 192 and 194 to the roof panel 18. Bolt 185 having bolt head 187 on one side and nut 189 on another side holds panel portion 184 in place.

Figure 8:
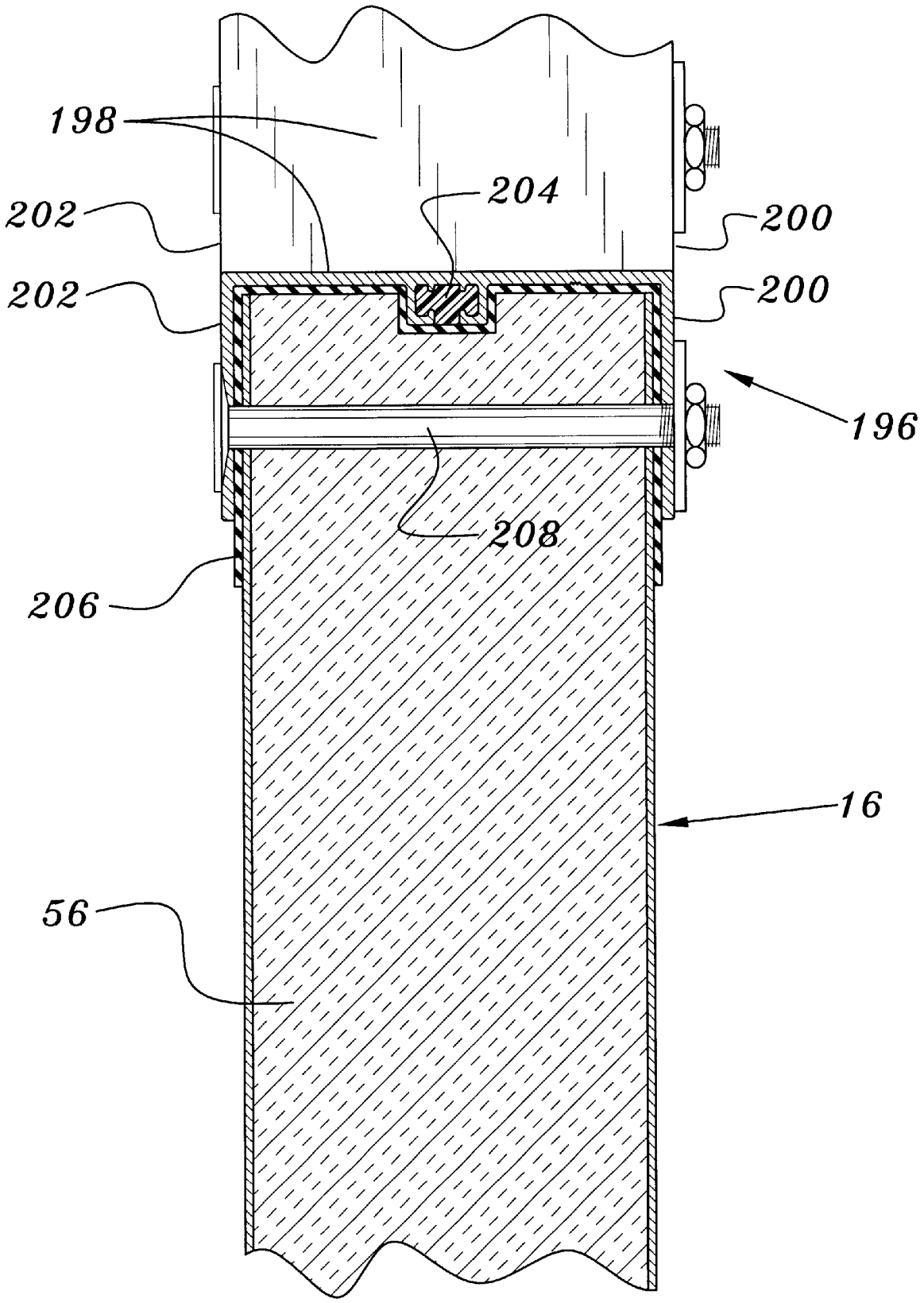
FIG. 8 is a cross-sectional view of a door or window extrusion with a panel.

As see n in FIG. 8, a window or doorway 22 adapter extrusion 196 has a base 198 and sidewalls 200 and 202. A thermal break 204 is located below base 198 and rubber gasket 206 is placed between the adapter 196 and the panel 16. A bolt 208 holds the panel 16 in place between sidewalls 200 and 202.

The panels 16 and 18 are usually 4×8 feet in size and have steel external sheets 52 and 53 enclosing a polystyrene insulation. The adapters are extruded aluminum which are made in accordance with well known procedures in the prior art.

The use of the panels and adapters described will result in the rapid construction of an exterior building shell that is completely insulated and without the need for internal studs.

The above description has described specific structural details embodying this invention. However, it will be within one having skill in the art to make modifications without departing from the spirit and scope of the underlying inventive concept of this modular building structure. The inventive concept is not limited to the structure described, but includes such modifications except as limited by the scope of the appended claims.

Having thus described the invention, what is claimed and desired to be secured by Letters Patent is:

1. A modular building frame system comprising:

(a) an edge adapter having a base plate, the edge adapter mounted through the base plate to a protruding threaded portion of a rod imbedded in a concrete pad, the edge adapter having integral with opposed edges of the base plate a first outside and second inside upwardly directed parallel side walls adapted to receive sandwiched between the sidewalls the lower portion of an insulated wall panel, an electrical way integral with the second inside side wall and a transverse fastener for attaching together the side walls, the lower portion of the insulated wall panel and the electrical way, the edge adapter base plate tapering downwardly towards the first outside side wall for water drainage;

(b) an interlocking fastener mounted on an edge of the insulated wall panel distal from the edge adapter, the interlocking fastener engaging a corresponding fastener of an adjacent upwardly mounted insulated wall panel, the fasteners providing a space between adjacent panels;

(c) a corner connector having first and second U-shaped brackets, each bracket fastened to an edge portion of an insulated wall panel at right angles to each other, a base portion of each U-shaped bracket having an annular pivot groove for receipt of a ball, a ball attached at each opposite end of a transverse member, the balls adapted for receipt in the pivot groove on each bracket so that the insulated panels can be rotated to a suitable fixed position with respect to each other, the transverse member having a pair of upwardly directed arcuate leaves, an arcuate leaf outwardly directed from the base portion of each U-shaped bracket juxtaposed to one of the arcuate leaves from the transverse member, the juxtaposed leaves fastened together after the panels are in a suitable position with respect to each other;

(d) a roof eve connector for joining a top portion of the insulated wall panel to an insulated roof panel, the roof eve connector having a U-shaped bracket enclosing a top portion of the insulated wall panel with a transverse fastener attaching the roof connector bracket to the top portion of the wall panel, a base portion of the U-shaped bracket integral with an annular groove for receipt of a ball integral with an L-shaped plate attached to the insulated roof panel, the ball pivoting in the annular groove to a suitable fixed position of the wall panel with respect to the roof panel, an arcuate leaf upwardly directed from the base portion juxtaposed to an arcuate leaf downwardly directed from the L-shaped plate, the leaves fastened together after suitably aligning the wall panel and roof panel pitch with respect to each other; and (e) a roof cap connector having two components linked together; namely, a first and second base plate each base plate having downwardly projecting inner and outer sidewalls enclosing the top portion of an insulated roof panel, the sidewalls holding the roof panel by a transverse fastener passing through the sidewalls and the roof panel, a lower arcuate leaf downwardly directed from each inner side wall and an upper arcuate leaf upwardly directed from each base plate, an end portion of the lower arcuate leaves from each inner side wall and the upper arcuate leaves from each base plate juxtaposed so that the roof panels can be moved with respect to each other until at a final position the upper arcuate leaves are fastened together and the lower arcuate leaves are fastened together and a cap plate is mounted over the roof cap connector.

2. The modular building frame system according to claim 1 wherein the edge adapter base plate includes a thermal break.

3. The modular building frame system according to claim 1 wherein the electrical way has a pivotable cover distal from the second inside side wall so that access to electrical systems can be obtained from inside the building frame.

4. The modular building frame system according to claim 1 wherein a space is provided between an inner surface of the wall panel of the edge adapter and a wall surface of the electrical way for receipt of a bottom portion of an interior sheet rock panel.

5. The modular building frame system according to claim 1 wherein a rubber gasket is mounted between an inner surface of the edge adapter and the lower portion of the insulated wall panel.

6. The modular building frame system according to claim 1 wherein the interlocking fasteners each have one long end and one short end containing corresponding snap and lock components.

7. The modular building frame system according to claim 1 wherein an electrical way is interposed between a top surface of the transverse member and the upwardly directed arcuate leaves of the corner connector.

8. The modular building frame system according to claim 1 wherein an electrical way is integral with the L-shaped plate in the roof eve connector.

9. The modular building frame system according to claim 1 wherein each base plate in the roof cap connector includes an electrical way.

10. A modular building constructed from components comprising:

(a) multiple edge adapters each having a base plate, each edge adapter bolted through the base plate to a protruding threaded portion of a rod imbedded in a concrete pad, each base plate having a first outside and second inside upwardly directed parallel side walls adapted to receive sandwiched therebetween the lower portion on an insulated wall panel, each base plate additionally having an outside downwardly directed side wall overlapping an edge of the concrete pad, an electrical way integral with the second inside side wall and a transverse fastener for attaching together the side walls, the lower portion of the insulated wall panel and the electrical way, the edge adapter base plate tapering downwardly towards the first outside side wall to a hole in the first outside wall for water drainage;

(b) an interlocking fastener mounted on an edge of each insulated wall panel distal from the edge adapter, the interlocking fastener engaging a corresponding fastener of an adjacent upwardly mounted insulated wall panel, the fasteners providing a space between adjacent panels adapted to receive an I-beam;

(c) multiple corner connectors each having first and second base plates, each base plate having an inside and outside wall enclosing an edge portion of an insulated wall panel substantially at right angles to each other, a transverse fastener fastening the inside and outside walls to the edge portion of the insulated wall panel, each base plate having an annular pivot groove and an outwardly extending arcuate leaf on an outside surface, a transverse member having a ball descending from each opposed end adapted for receipt in the annular pivot groove of each base plate so that the insulated panels can be rotated to a suitable fixed position with respect to each other, the transverse member additionally having a pair of upwardly directed arcuate leaves, one of each pair juxtaposed with the outwardly extending arcuate leaf from each base plate, the leaves fastened together after the panels are in a suitable fixed position;

(d) multiple roof eve connectors for joining a top portion of the insulated wall panel to an insulated roof panel, each roof eve connector having a base plate and an outer and inner side wall enclosing a top portion of a wall panel with a transverse fastener for holding the top portion of the wall panel between the inner and out side wall, an outer surface of the base plate having an annular groove for receipt of a ball attached at the end of an L-shaped bracket, a longer side of the L-shaped bracket juxtaposed to a lower surface of the insulated roof panel, the longer side having an arcuate leaf descending from a lower surface and juxtaposed to an arcuate leaf ascending from the outer surface of the base plate, a transverse fastener holding the descending and ascending arcuate leaves together after a suitable pitch between the insulated wall panel and insulated roof panel is achieved;

(e) multiple roof cap connectors each having a first and second base plate and inner and outer side walls enclosing the top portion of an insulated roof panel, the side walls holding the roof panel by a transverse fastener passing through the inner and outer side wall and the top portion of the insulated roof panel, a lower arcuate leaf downwardly directed from each inner side wall juxtaposed to each other, an upper arcuate leaf from each base plate juxtaposed to each other so that the insulated roof panels can be moved with respect to each other until at a final position the upper arcuate leaves are fastened together and the lower arcuate leaves are fastened together and a cap plate is mounted over the roof cap connector.

11. The modular building according to claim 10 wherein multiple window or door connectors each have a U-shaped configuration over a portion of an insulated wall panel and a transverse bolt holds the insulated wall panel within the U-shaped configuration.

12. The modular building according to claim 10 wherein multiple cable adapters each have a base plate with descending side walls enclosing a top portion of an insulated side wall, the side wall held in place by a transverse bolt, the base plate having extended ears outwardly from each side wall and an insulated roof panel is bolted to each ear.

13. The modular building according to claim 10 wherein a rubber gasket is located between each inner surface of a base plate together with side walls and an outside surface of an insulated panel within the side walls.

14. The modular building according to claim 10 wherein a thermal break is included within each base plate.

15. A method of constructing a building by a series of steps comprising:

(a) providing multiple edge adapters, each edge adapter having a base plate, mounting each edge adapter to a protruding threaded portion of a rod imbedded in a concrete pad; providing a first outside and second inside upwardly directed side wall from the base plate, the base plate tapering downwardly towards a drainage hole in the first outside side wall, mounting a lower portion of an insulated wall panel between the first and second upwardly directed sidewalls; providing a downwardly directed sidewall on each edge adapter base plate at an outside edge and overlapping an edge of the concrete pad with the downwardly directed sidewall; providing an electrical way integral with the second inside wall and fastening the first and second upwardly directed sidewalls and the lower portion of the insulated wall panel together with a transverse fastener to hold the panel in place between the first and second upwardly directed sidewalls;

(b) providing adjacent insulated wall panels and locking the adjacent insulated wall panels together with interlocking fasteners, the fasteners providing a space between the adjacent panels;

(c) providing multiple corner connectors each having first and second base plates, each base plate having an inside and outside wall enclosing an edge portion of an insulated wall panel substantially at right angles to each other, fastening the inside wall, the edge portion of the insulated wall panel and the outside wall together with a transverse fastener; providing each base plate with an annular pivot groove and an outwardly extending arcuate leaf on an outside surface, providing a transverse member having a ball descending from each opposed end, mounting each ball in the pivot groove and rotating the insulated wall panels to a suitable fixed position with respect to each other, providing a pair of upwardly directed arcuate leaves from a center portion of the transverse member and fastening together an arcuate leaf from the base plate to an arcuate leaf from the transverse member after the panels are in a suitable fixed position;

(d) providing multiple roof eve connectors joining a top portion of the insulated wall panel to an insulated roof panel, providing the roof eve connectors with a base plate integral with an outer and inner sidewall enclosing a top portion of a wall panel between the outer and inner sidewall and fastening the wall panel to the outer and inner sidewalls with a transverse fastener, providing an outer surface of the base plate with an annular groove, mounting a ball attached at the end of an L-shaped bracket in the groove, providing the L-shaped bracket with a longer side juxtaposed to a lower surface of the insulated roof panel, providing the longer side with an arcuate leaf descending from a lower surface, the descending leaf positioned adjacent an arcuate leaf ascending from the outer surface of the base plate and fastening the descending and ascending leaves together after a suitable pitch between the insulated wall panel and roof panel is achieved; and (e) providing multiple roof cap connectors each having a first and second base plate and inner and outer walls enclosing the top portion of an insulated roof panel with the inner and outer walls and fastening them together with a transverse fastener, providing a lower arcuate leaf downwardly directed from each inner sidewall juxtaposed to each other, providing an upper arcuate leaf from each base plate juxtaposed to each other and moving the insulated roof panels with respect to each other until at a final position the upper arcuate leaves are fastened together and the lower arcuate leaves are fastened together and a cap is mounted over the roof cap connector.

16. The method of constructing a building according to claim 15 wherein an I-beam is mounted in the space between adjacent wall panels in step (b).

17. The method of constructing a building according to claim 15 wherein a pivotable door is provided on the electrical way of step (a).

18. The method of constructing a building according to claim 15 wherein a rubber gasket layer is provided between each base plate sidewall and wall panel in steps (a) and (c).

19. The method of constructing a building according to claim 15 wherein multiple window or door connectors are provided, each window or door connector having a U-shaped configuration fastened over an insulated wall panel edge portion and the U-shaped configuration is fastened to the insulated wall panel with a transverse bolt.

* * * * *